US007658024B2

(12) United States Patent
Launder et al.

(10) Patent No.: US 7,658,024 B2
(45) Date of Patent: Feb. 9, 2010

(54) UNIVERSAL DIGGING TOOTH ATTACHMENT APPARATUS

(75) Inventors: Brian L. Launder, Tulsa, OK (US); Charles Clendenning, Broken Arrow, OK (US)

(73) Assignee: H&L Tooth Company, Tulsa, OK (US)

( * ) Notice: Subject to any disclaimer, the term of this patent is extended or adjusted under 35 U.S.C. 154(b) by 466 days.

(21) Appl. No.: 11/481,643

(22) Filed: Jul. 6, 2006

(65) Prior Publication Data

US 2008/0005939 A1 Jan. 10, 2008

(51) Int. Cl.
*E02F 3/08* (2006.01)
*E02F 5/02* (2006.01)
*E21C 25/10* (2006.01)

(52) U.S. Cl. ..... 37/454; 37/455; 37/449; 299/85.2; 299/102

(58) Field of Classification Search ..... 37/457, 37/449, 450, 452–456, 406, 409, 903; 299/79.1, 299/85.2, 102, 103; 414/722
See application file for complete search history.

(56) References Cited

U.S. PATENT DOCUMENTS

| | | | | | |
|---|---|---|---|---|---|
| 820,906 | A | | 5/1906 | Bodette | |
| 2,047,862 | A | | 7/1936 | Drummond | |
| 2,971,280 | A | * | 2/1961 | Smedley | 37/455 |
| 3,460,690 | A | * | 8/1969 | Seifert | 414/697 |
| 3,462,861 | A | * | 8/1969 | Kampert | 37/453 |
| 3,743,358 | A | * | 7/1973 | Guest | 299/40.1 |
| 3,751,115 | A | * | 8/1973 | Proctor | 299/109 |
| 3,774,324 | A | * | 11/1973 | Lafond | 37/457 |
| 3,841,007 | A | * | 10/1974 | Howarth et al. | 37/455 |
| 3,908,844 | A | * | 9/1975 | Duffield | 414/724 |
| 4,027,408 | A | | 6/1977 | Ramella et al. | |
| 4,103,442 | A | * | 8/1978 | Zepf | 37/452 |
| 4,120,105 | A | * | 10/1978 | Stepe | 37/455 |
| 4,180,926 | A | * | 1/1980 | Klett et al. | 37/455 |
| 4,932,145 | A | | 6/1990 | Reeves, Jr. | |
| 5,423,138 | A | * | 6/1995 | Livesay et al. | 37/456 |
| 5,638,621 | A | * | 6/1997 | Keech et al. | 37/446 |

(Continued)

FOREIGN PATENT DOCUMENTS

| | | |
|---|---|---|
| GB | 1205 070 | 9/1970 |

*Primary Examiner*—Thomas B Will
*Assistant Examiner*—Abigail A Risic
(74) *Attorney, Agent, or Firm*—Law Office of John W. Harbst

(57) ABSTRACT

A universal digging tooth attachment apparatus adapted to be secured to a forward edge of a bucket lip of an earth moving implement. The universal digging tooth attachment has a first element with an elongate section defining a first generally planar surface for abutting and engaging along the length thereof with one face of the bucket lip of the earth moving implement and a second element. The second element has an elongate section defining a second generally planar surface for abutting and engaging along the length thereof with the bucket lip of the earth moving implement directly opposite from the elongate section of the first element. One of the first and second elements has an earth engaging tooth projecting therefrom. A slip joint operably connects the first and second elements to each other to allow for adjustment of a distance between the first and second planar surfaces to accommodate attachment of the digging tooth to implements having bucket lips of differing thicknesses.

18 Claims, 7 Drawing Sheets

U.S. PATENT DOCUMENTS

| | | | | |
|---|---|---|---|---|
| 5,918,391 | A * | 7/1999 | Vinas Peya | 37/452 |
| 6,022,184 | A * | 2/2000 | Friedland | 414/724 |
| 6,209,238 | B1 * | 4/2001 | Ruvang | 37/455 |
| 6,457,268 | B1 * | 10/2002 | Perry et al. | 37/403 |
| 6,564,482 | B2 * | 5/2003 | Ruvang | 37/456 |
| 7,036,249 | B2 * | 5/2006 | Mautino | 37/457 |
| 7,080,470 | B2 * | 7/2006 | Jones | 37/452 |
| 7,100,315 | B2 * | 9/2006 | Carpenter et al. | 37/454 |
| 2002/0083803 | A1 * | 7/2002 | Ping | 81/394 |
| 2004/0083630 | A1 * | 5/2004 | Ruvang | 37/456 |
| 2004/0244236 | A1 | 12/2004 | Mautino | |
| 2006/0265916 | A1 * | 11/2006 | Carpenter et al. | 37/452 |

* cited by examiner

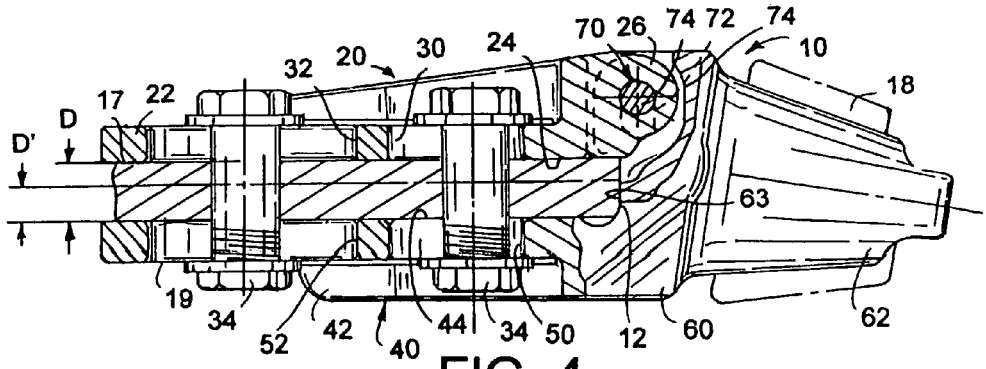
FIG. 4
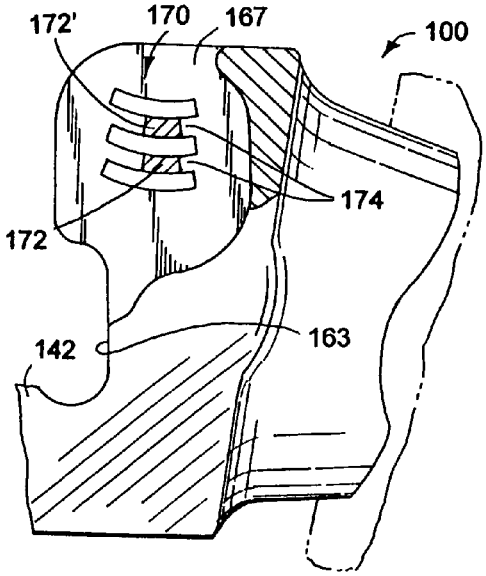
FIG. 7
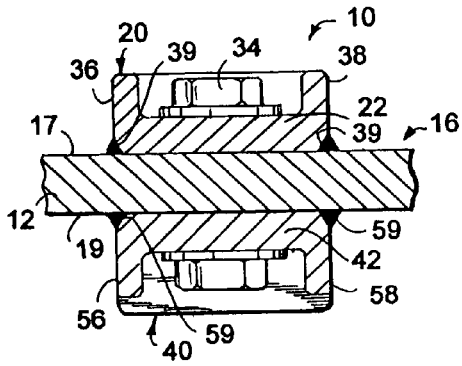
FIG. 5
FIG. 6
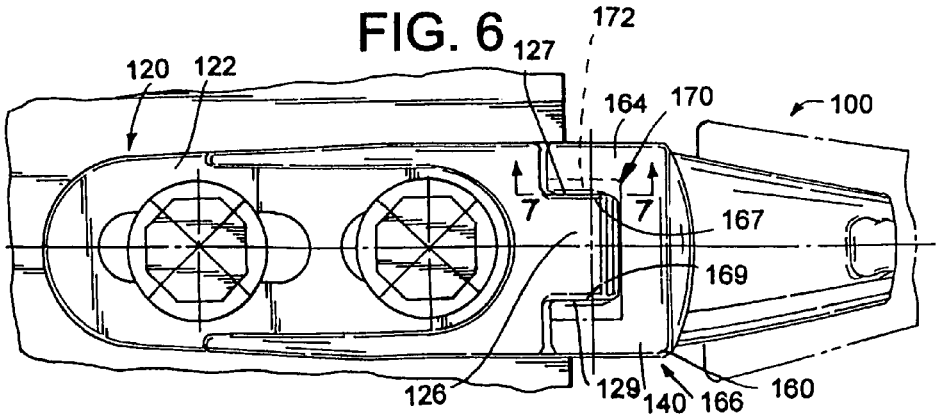

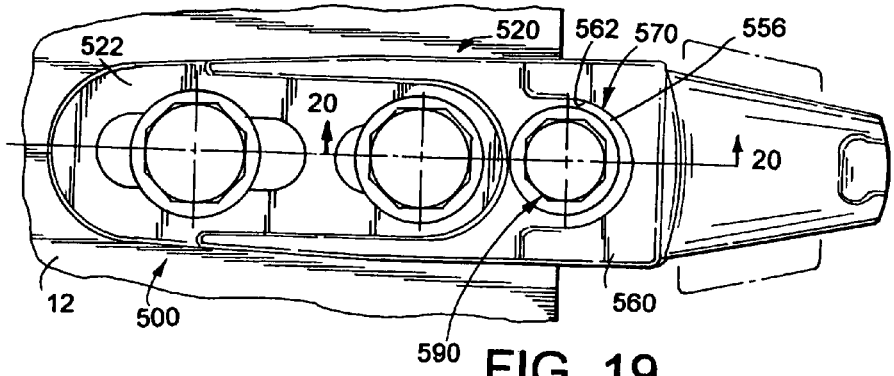
FIG. 19
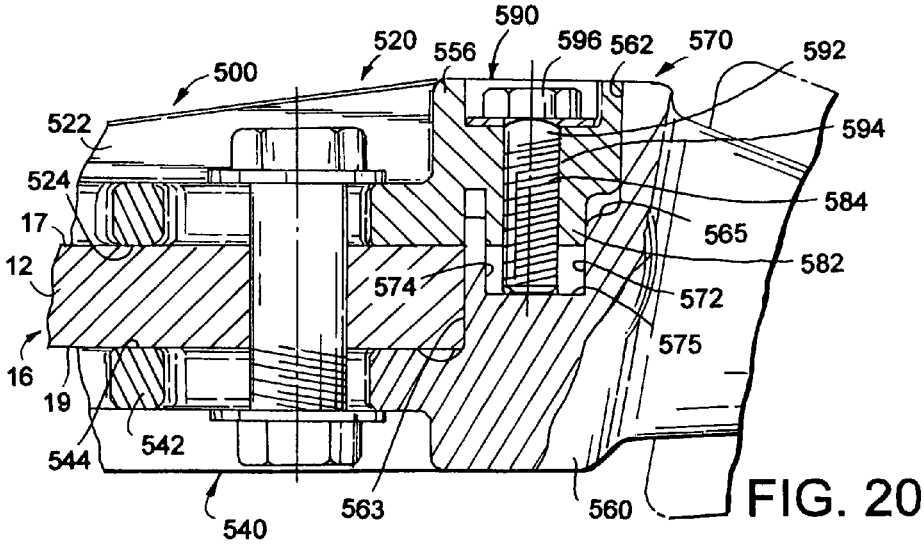
FIG. 20
FIG. 21
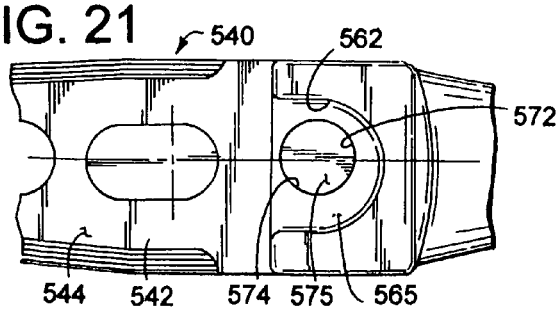
FIG. 22
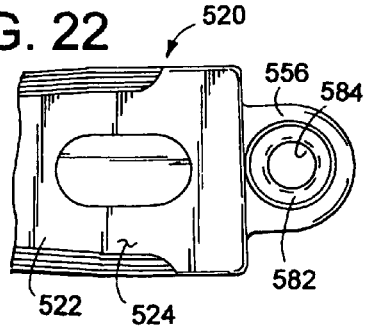

UNIVERSAL DIGGING TOOTH ATTACHMENT APPARATUS

FIELD OF THE INVENTION

The present invention disclosure generally relates to a ground engaging digging tooth and, more particularly, to a universal apparatus for attaching a ground engaging digging tooth to an earth moving implement.

BACKGROUND OF THE INVENTION

The population or mix of construction equipment has transformed in recent years. With the ever increasing cost of land, the square footage or size of various lots is becoming smaller. Accordingly, the size of construction equipment has likewise decreased. Construction equipment is now available in compact configurations. For example, "mini excavators" or compact excavators are available by numerous manufacturers in several size choices, due to the compact utility they offer.

Such construction equipment typically includes a bucket, scoop or similar ground moving implement mounted on a movable machine. Such an implement has multiple walls including a bottom wall. The bottom wall of the implement terminates in a forward or front edge. Alternatively, a bucket lip is secured to the front edge of the bottom wall of the implement. As used herein, the term "bucket lip" means and refers to a forward or front portion of the bucket/implement whether such portion is formed as part of the bottom wall of the implement or is secured thereto. In some implement designs, a front edge of the bucket lip has an angled surface or bevel which acts as a blade. Moreover, a series of ground engaging teeth can project longitudinally forward from the bucket lip to facilitate ground penetration the implement.

The ground engaging teeth for such implements have a form which facilitates their penetration into the ground, and they must, moreover, retain this form as long as possible during their operational life despite the wear to which they are subjected. The dimensions and shape of these teeth must be able, as far as possible, to withstand the considerable forces which occur during operation. Additionally, the connection of the teeth to the bucket lip must be sufficiently robust as to inhibit inadvertent separation of the teeth from the bucket. Moreover, the shape of the teeth must ensure good penetration of the front edge of the bottom wall of the bucket.

Ground engaging teeth typically come in two styles. One style of digging tooth involves a unitary or one-piece design including an appropriately shaped or configured tooth portion with either one, one and one half or a pair of elongate sections or legs longitudinally extending from and for securing the tooth portion to the bucket. With this design, however, and after the tooth portion of the digging tooth wears and requires replacement, there is a considerable amount of digging tooth material (throw-away) which is wasted and irretrievably lost when the worn digging tooth is replaced.

The other style of digging tooth commonly used in the industry embodies a two-piece or multipiece design. With this design, one piece of the digging tooth is configured as an adapter having a nose portion and base portion. The adapter nose portion is configured to releasably accommodate the other piece of the multipiece digging tooth design, i.e., the digging tooth or tip. To advantageously reduce the amount of throw-away, this multipiece design allows replacement of only the digging tooth or tip portion of the tooth design, when required. Typically, and depending upon digging conditions, three to ten digging tooth replacements can be used before the adapter is sufficiently worn as to require replacement.

As with the unitary tooth design, the base portion of the adapter embodies alternative designs. The first adapter base portion design includes a single leg or elongate section which engages with a top surface of the bucket lip and extends longitudinally from a body section of the adapter. This design is usually used in those applications where lesser digging forces are expected to be applied to the digging tooth during operation of the digging implement. The other adapter base portion designs include either one and one half or two bifurcated and elongated sections which embrace top and bottom vertically spaced faces of the bucket lip and extend longitudinally from the body section of the adapter.

The value of a double strap or double leg design is its increased strength over a single leg or a leg and one half designed adapter. Of course, the enhanced value of a double strap or double leg design is lost if the double legs are not operably conjoined with the body section of the adapter. Without the top and bottom elongate or leg sections being manufactured as an integral unit, or alternatively, mechanically attached to each other, the strength provided to the adapter is no greater than two separate single legs being provided on the base portion of the adapter. Regardless of the base portion design, it is highly desirable to have each elongate section, used to mount the digging tooth to the bucket, longitudinally supported along the full length of each elongate section.

Problems occur in designing teeth for such implements. One such problem involves the lack of conformity between the numerous bucket designs offered by different implement manufacturers. That is, there is little or no standardization regarding bucket or implement designs between the various bucket manufacturers. As a result, and although different manufacturers frequently list the bucket designs as being similar, an actual comparison between the bucket designs offered by different manufacturers can and often do result in: differing bucket lip thicknesses, different angles for the bevel on the bucket lip; different blunt thicknesses, and differing bolt hole location spacings and size (in the case of bolt-on adapters). Bolt-on adapters are preferred, since this allows an operator the option of removing the adapters/teeth when they desire to dig with only the bucket. Besides the above, the configuration and angle or pitch of the nose portion on the adapter can and often do differ between manufacturers.

Because of the lack of standardization between the various bucket manufacturers, when an operator needs to replace an adapter of a multipiece digging tooth or a unitary digging tooth, the operator must return to the original equipment dealer for such replacement parts since the parts made by other manufacturers are not likely to fit and mate with the particular bucket requiring new parts. Very few of the thousands of independent dealers across the country are likely to have a wide choice of different adapters or one-piece tooth designs that fit the particular needs of a specific operator. That is, to facilitate such an accommodation, each independent dealer would be required to inventory scores of various adapters and/or one-piece digging teeth. This would create tremendous inventories, confusion and monetary waste.

Thus, there is a need and continuing desire for a universal digging tooth attachment apparatus which accommodates differences or variations between: the thicknesses of the bucket lip used on various implements, the angle of the bevel on the bucket lip, blunt thickness, and bolt-hole location spacings and size (in the case of bolt-on adapters), as well as differences between the angle or pitch of the nose portion of the adapter.

SUMMARY OF THE INVENTION

In view of the above- and in accordance with one aspect, there is provided a universal digging tooth attachment apparatus adapted for securement to a bucket lip of an earth moving implement. The universal digging tooth attachment includes a first element having an elongate section with a first generally planar surface adapted to abut and engage with one face of the bucket lip and a second element. The second element has an elongate section defining a second generally planar surface adapted to abut and engage with a second face of the bucket lip directly opposite from the elongate section of the first element. One of the first and second elements has an earth engaging tooth projecting therefrom. The first and second elements are interconnected to each other by a slip joint allowing for variable positioning of the first and second elements relative to each other and thereby permitting adjustment of a distance between the first and second planar surfaces to accommodate attachment of the digging tooth to different buckets having bucket lips which may and very likely do vary in thickness relative to each other.

To accommodate differences in bolt hole locations on various bucket designs, the elongate section of both of the first and second elements preferably defines a longitudinally elongated slot therein. To facilitate securement of the universal digging tooth attachment apparatus as by welding to the earth moving implement, the elongate section of at least one of the first and second elements includes a chamfer extending along a major lengthwise portion of the elongated section of the least one of the first and second elements.

In one form, the slip joint between the first and second element includes cooperating instrumentalities on the first and second elements. In one form, the cooperating instrumentalities establish a plurality of vertically spaced fulcrum supports about which the first and second elements can be adjusted relative to each other.

In another form, the slip joint between the first and second elements includes a generally vertical open-sided channel defined by one of the first and second elements and a guide element carried by the other of the first and second elements and projecting into the open-sided channel. The guide element is movable within limits defined by the channel so as to allow for variable positioning of the first and second elements relative to each other and thereby permitting adjustment of the distance between the generally planar surfaces of the first and second elements.

In the embodiment wherein the slip joint for connecting the first and second elements includes a generally vertical channel, such slip joint preferably includes a series of vertically spaced slotways forming adjustable fulcrum supports for the guide element. The vertically adjacent slotways are preferably joined by a guideway so as to permit the guide element to move between adjacent slotways and thereby adjust the distance between the generally planar surfaces of the first and second elements to accommodate variations in the bucket lip including different wall thicknesses, bevel angles, and blunt thicknesses.

According to another aspect, there is provided a universal digging tooth attachment apparatus adapted for securement to an earth moving implement. According to this aspect, the universal digging tooth attachment includes a two-piece adapter, with one piece of the adapter having a body section with a nose portion extending in a first longitudinal direction away from the body section and which is configured to releasably accommodate a ground engaging tooth thereon. An elongate section extends in an opposite longitudinal direction from the body section. The elongate section defines a first generally planar surface adapted to abut and engage with one face of the bucket lip. A second piece of the adapter has an elongate section with a second generally planar surface adapted to abut and engage with a second face of the bucket lip directly opposite from the elongate section of the first piece. The two pieces of the adapter are interconnected to each other by a slip joint allowing for variable vertical adjustment of first and second planar surfaces relative to each other while maintaining the two pieces of the adapter in interconnected relation relative to each other and while maintaining the first and second generally parallel surfaces on the two pieces of the adapter in generally parallel relation relative to each other throughout the range of adjustment.

To accommodate variations in bolt-hole placement, each elongate section of the two pieces of the adapter preferably defines an elongated opening therein. Each elongated opening has a closed margin for allowing a fastener to extend therethrough. Moreover, in a preferred embodiment, the elongate section of each piece of the adapter defines, as an integral part thereof, a series of compressible and spaced ridges on that surface of the pieces opposed to the generally parallel surface. The compressible ridges preferably extend generally parallel relative to each other and away from the closed margin of said opening. To facilitate securement of the universal digging tooth attachment apparatus as by welding to the earth moving implement, the elongate section of at least one of the two pieces of adapter includes a chamfer extending along a major lengthwise portion of the elongated section of that element.

In one form, the slip joint for interconnecting the first and second pieces of the adapter includes cooperating instrumentalities on the adapter pieces. In one form, the cooperating instrumentalities establish a plurality of vertically spaced fulcrum supports about which the first and second adapter pieces can be adjusted relative to each other thereby adjusting the vertical distance separating the generally planar surface on the adapter pieces.

In one embodiment, one of the adapter pieces includes a pair of ears defining inner surfaces which are spaced apart by a predetermined distance. The other piece of the adapter includes a projection having two laterally spaced outer surfaces arranged a predetermined distance apart. The inner and outer surfaces on the first and second adapter pieces define cooperating instrumentalities forming the slip joint and which allow for variable positioning of the first and second adapter pieces relative to each other and thereby permitting adjustment of the distance between the generally planar surfaces of the first and second adapter pieces.

In another form, the slip joint includes a generally vertical open-sided channel defined by one of the pieces of the adapter and a fulcrum pin carried by the other piece of the adapter and projecting into the open-sided channel. The fulcrum pin is movable within predetermined limits defined by the channel so as to allow for variable positioning of the pieces of the adapter relative to each other and thereby permitting adjustment of the distance between the generally planar surfaces of the pieces of the adapter.

Another aspect relates to providing a universal digging tooth attachment apparatus adapted for securement to a bucket lip of a ground engaging implement. The universal digging tooth attachment includes a multipiece adapter having a body section configured to releasably accommodate a ground engaging tooth thereon and a first elongate section longitudinally extending from the body section. The first elongate section defines a first generally planar surface adapted to abut and engage with one face of the bucket lip. The multipiece adapter further includes a second elongate section defining a second generally planar surface adapted to abut and engage with a second face of the bucket lip directly opposite from the first elongate section. The second elongate section of the multipiece adapter is interconnected to the body section of the adapter by a slip joint allowing for variable vertical adjustment of first and second planar surfaces relative to each other while maintaining the body section and the second elongate section of said multipiece adapter in interconnected relation relative to each other throughout the range of adjustment of the multipiece adapter.

To accommodate variations in bolt-hole placement, each elongate section of the each elongate section of the adapter preferably defines an elongated opening therein. Each elongated opening has a closed margin for allowing a fastener to extend therethrough. Moreover, in a preferred embodiment, each elongate section of each piece of the adapter defines, as an integral part thereof, a series of spaced ridges on that surface of the pieces opposed to the generally parallel surface. The ridges preferably extend generally parallel relative to each other and away from the closed margin of said opening. To facilitate securement of the universal digging tooth attachment apparatus as by welding to the ground engaging implement, at least one elongate section of the adapter includes a chamfer extending along a major lengthwise portion thereof.

In one embodiment, the slip joint includes cooperating instrumentalities on the second elongate section and the body section of the adapter for establishing a plurality of vertically spaced fulcrum supports about which the first and second elongate sections of the multipiece adapter can be pivotally adjusted relative to each other.

In another embodiment, the slip joint includes a generally vertical open-sided channel defined by one of the second elongate section and the body section and a guide element carried by the other of the second elongate section and the body section. The guide element projects into the open-sided channel and is movable within predetermined limits defined by the channel so as to allow for variable positioning of the first and second elongate sections relative to each other and thereby permitting adjustment of the distance between the generally planar surfaces defined by said first and second elongate sections.

Another multipiece adapter embodiment involves using a second slip joint for interconnecting the first elongate section to the body section of the adapter. The second slip joint, in combination with the other slip joint, allows for adjustment of the pitch of the nose portion of said multipiece adapter relative to the bottom wall of the earth moving implement. Preferably, the second slip joint includes a generally vertical open-sided channel defined by one of the first elongate section and the body section along with a guide element carried by the first elongate section. The guide element of the second slip joint projects into the open-sided channel and is movable within predetermined limits defined by the channel so as to also allow for variable positioning of the first and second elongate sections relative to each other and thereby permitting adjustment of the distance between the generally planar surfaces defined by the first and second elongate sections of the multipiece adapter.

A primary feature of this invention disclosure involves providing a universal apparatus for attaching an earth engaging tool to an implement and for readily accommodating variations in the bucket lip of different implements.

Another feature of the present invention disclosure relates to a significant reduction in the amount of throw-away associated with the present invention disclosure.

Still another feature of the present invention disclosure relates to an ability to readily change the pitch of the digging tooth.

These and other features, objects and advantages of the invention disclosure will become more readily apparent from the following detailed description, drawings, and appended claims.

BRIEF DESCRIPTION OF THE DRAWINGS

FIG. 4 is a longitudinal sectional view taken along line 4-4 of FIG. 2;

FIG. 5 is a view taken along line 5-5 of FIG. 2;

FIG. 6 is a top plan view of an alternative embodiment of the present invention disclosure;

FIG. 7 is an enlarged sectional view taken along line 7-7 of FIG. 6;

FIG. 19 is a top plan view of another embodiment of the present invention disclosure;

FIG. 20 is an enlarged fragmentary longitudinal sectional view taken along line 20-20 of FIG. 19;

FIG. 21 is a fragmentary top plan view of one of the elements forming one embodiment of the multipiece universal adapter of the present invention disclosure; and FIG. 22 is a bottom plan view of another of the elements forming one embodiment of the multipiece universal adapter of the present invention disclosure.

DETAILED DESCRIPTION OF THE INVENTION

Figure 1:
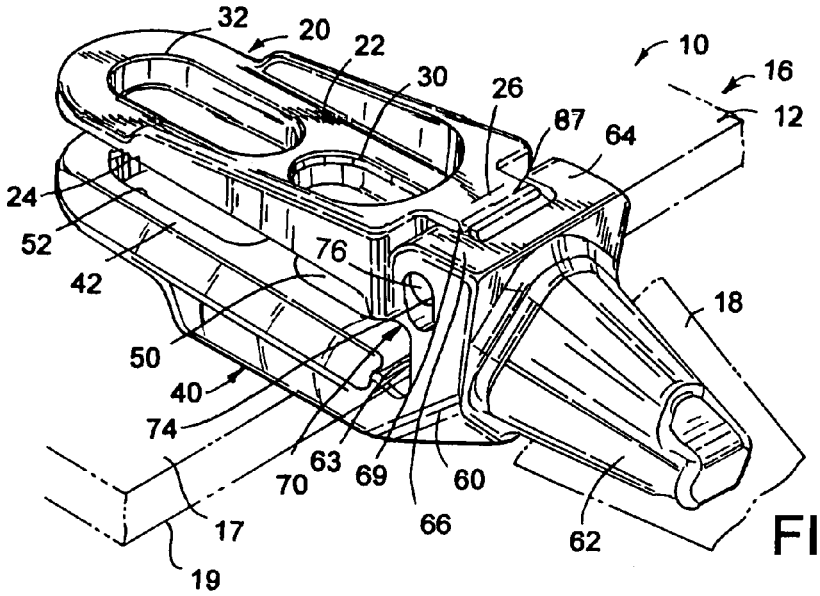
FIG. 1 is a left top perspective view of one embodiment of the present invention disclosure.

While the present invention disclosure is susceptible of embodiment in multiple forms, there is shown in the drawings and will hereinafter be described preferred embodiments, with the understanding the present disclosure is to be considered as setting forth exemplifications of the invention disclosure which are not intended to limit the invention disclosure to the specific embodiments illustrated and described.

Referring now to the drawings, wherein like reference numerals indicate like parts throughout the several view, there is shown in FIG. 1 one form of a multipiece and universal digging tooth attachment apparatus, generally identified by reference numeral 10. As shown, the universal digging tooth attachment apparatus 10 arranged in operable combination with a bucket lip 12 of an earth moving implement such as a bucket or scoop 16. Albeit well suited for smaller implements, the teachings and principals of the present invention are equally applicable to larger ground engaging implements as well. Although only one is shown mounted thereon, the bucket lip 12 can have a plurality of such universal apparatuses thereon. As shown, each apparatus 10 is provided with a digging tooth 18 projecting longitudinally forward from the bucket lip 12.

Figure 2:
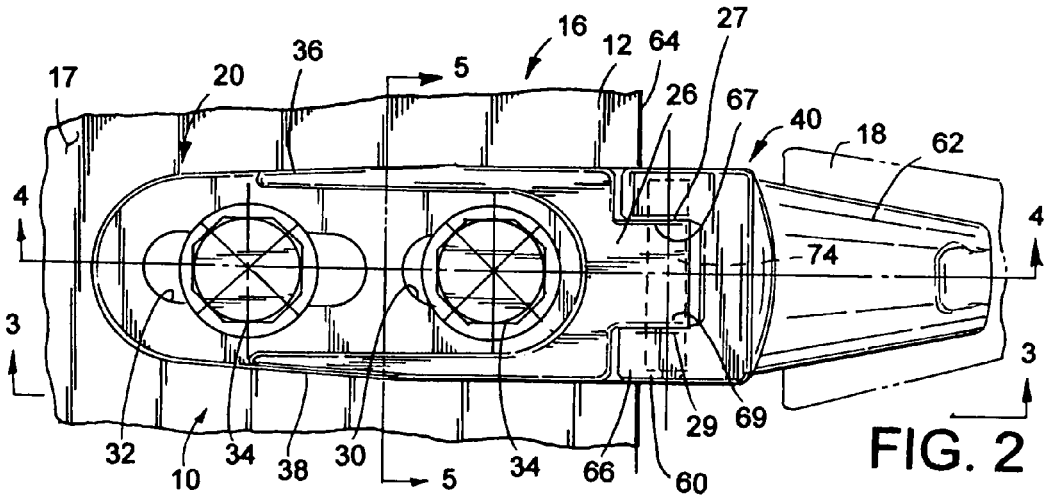
FIG. 2 is a top plan view of the embodiment of the invention disclosure illustrated in FIG. 1.
Figure 3:
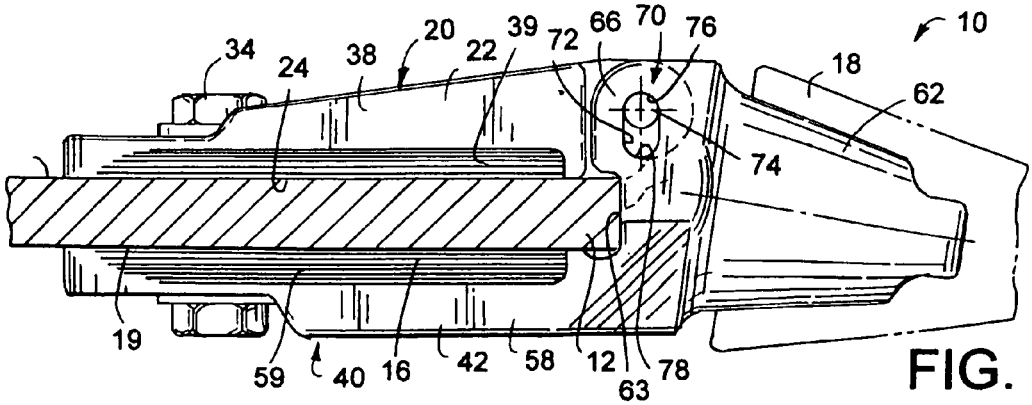
FIG. 3 is a sectional view taken along line 3-3 of FIG. 2.

In the embodiment illustrated in FIGS. 1 and 2, the multipiece apparatus 10 includes a first element 20 and a second element 40 interconnected to each other. One of the first and second elements 20 and 40, respectively, has the earth engaging tooth 18 longitudinally projecting therefrom. In the illustrated embodiment, element 20 is assembled to an upper side or surface 17 of the bucket lip portion 12. As shown in FIGS. 1 and 3, element 40 is assembled to a lower side or surface 19 of the bucket lip 12.

As shown in FIGS. 1, 3 and 4, element 20 has a longitudinally extended elongate section 22 defining a first generally planar surface 24. Along the length thereof, the planar surface 24 of section 22 is adapted to abut and engage with the upper side 17 of the bucket lip 12. At a forward end thereof, element 20 of apparatus 10 is provided with an attachment section 26 defining two generally parallel surfaces 27 and 29 (FIG. 2) spaced a predetermined lateral distance apart from each other.

To accommodate differences in bolt hole locations in implement 16, and as shown in FIGS. 1, 2 and 4, the longitudinally extended section 22 of element 20 preferably defines a pair of aligned and longitudinally elongated slots or openings 30 and 32. Each slot 30, 32 is preferably configured to allow a lengthwise portion of a suitable fastener assembly 34 including a conventional bolt to pass through the elongate section 22 to releasably secure the first element 20 to the upper side 17 of the bucket lip portion 12 of the implement 16.

As an alternative securement methodology, and as represented in FIG. 5, section 22 of the element 20 can be welded to the implement 16. As shown in FIG. 5, section 22 of element 20 includes laterally spaced and generally vertical side walls 36 and 38 extending along a major lengthwise portion of section 22. The side walls 36 and 38 are each configured to facilitate securement of section 22 to the upper side 17 of the bucket lip 12. More specifically, in the embodiment illustrated in FIG. 5, a lower and outer edge of each side wall 36, 38 has a chamfer 39 thereon for accommodating weld material, if the operator so desires, used to secure elongate section 22 to the upper side 17 of the bucket lip portion 12 of the implement 16.

As shown in FIGS. 1, 3 and 4, element 40 of apparatus 10 has a longitudinally extended elongate section 42 defining a generally planar surface 44. Along the length thereof, surface 44 of section 42 is adapted to abut and engage with the bottom or lower side or surface 19 of the bucket lip 12 directly opposite from the elongate section 22 of element 20.

To accommodate differences in bolt hole locations and/or spacings in implement 16, and as shown in FIGS. 1 and 4, the longitudinally extended elongate section 42 of the element 40 preferably defines a pair of aligned and longitudinally elongated slots or openings 50 and 52. Each slot 50, 52 is configured to allow a lengthwise portion of the bolt of fastener assembly 34 to pass through the elongate section 42 to releasably secure element 40 to the lower side 19 of the bucket lip 12 directly beneath elongate section 22 of element 20.

As with element 20, and as schematically represented in FIG. 5, section 42 of element 40 can be welded to the lower side 19 of the implement 16. As shown in FIG. 5, section 42 of element 40 includes laterally spaced and generally vertical side walls 56 and 58 extending along a major lengthwise portion of section 42. The side walls 56 and 58 are each configured to facilitate securement of section 42 to the lower side 19 of the bucket lip 12 of the implement 16. More specifically, and as shown in FIG. 5, a lower and outer edge of each side wall 56, 58 has a chamfer 59 thereon for accommodating weld material, if the operator so desires, used to secure section 42 to the lower side 19 of the bucket lip 12.

Apparatus 10 further includes an enlarged body section 60. In a preferred form, body section 60 is formed integral with and toward a forward end of element 40. Suffice it to say, the adapter body section 60 is preferably configured to offer wear protection to at least that portion of the first element 20 disposed rearwardly thereof. In the embodiment illustrated in FIGS. 1 through 4, body section 60 is configured with a nose portion 62 longitudinally extending forwardly therefrom. The nose portion 62 is configured to releasably accommodate the ground engaging tooth 18 thereon. As shown in FIGS. 3 and 4, body section 60 is provided with an abutment surface 63 extending transversely across the width thereof and against which a blunt end of the bucket lip 12 abuts when apparatus 10 is assembled to the implement 16.

In the illustrated embodiment, the nose portion 62 is advantageously provided with a generally rhombus-like cross-sectional configuration which preferably embodies the teachings of U.S. Pat. Nos. 6,047,487 and/or 6,247,255; the applicable portions of which are incorporated herein by reference. Of course, nose portion 62 of body section 60 can have other cross-sectional configurations other than that disclosed without detracting or departing from the spirt and scope of the invention. Alternatively, tooth 18 can be formed as an integral part of body section 60 without detracting or departing from the spirit and scope of the invention.

As shown in FIGS. 1 and 2, the body section 60 of element 40 is further provided with a pair of generally parallel ears or mounts 64 and 66 which project longitudinally rearward from the body section 60 in a direction opposed to the nose portion 62. Inner surfaces 67 and 69 on the ears or mounts 64 and 66, respectively, are laterally spaced apart a distance equal to or greater than the predetermined distance separating the laterally spaced surfaces 27 and 29 on the attachment section 26 on the first element 20 of the multipiece apparatus 10.

Due to the relatively large forces incurred by apparatus 10 during operation, it is most desirable to have the elongate sections 22 and 42 of each element or leg 20 and 40, respectively, of apparatus 10 longitudinally supported along the full length of their bucket lip engaging surfaces 24 and 44, respectively. To accomplish this and other desirous objectives, the multipiece apparatus 10 further includes a slip joint 70 allowing for variable positioning of the first and second elements 20 and 40, respectively, relative to each other.

As will be appreciated from FIG. 4, slip joint 70 advantageously permits substantially infinite adjustment of the distance between surfaces 24 and 44 of elements 20 and 40, respectively, anywhere within the range between D and D' thereby accommodating for variations in bucket lip thicknesses of different implements. Moreover, slip joint 70 maintains elements 20 and 40 of the universal apparatus 10 interconnected to each other throughout the range of vertical adjustment relative to each other, thus, enhancing the strength of apparatus 10. In a most preferred form, slip joint 70 permits adjustment of the vertical distance between bucket lip engaging surfaces 24 and 44 of elements 20 and 40, respectively, anywhere between D and D' (FIG. 4) while maintaining those surfaces 24, 44 in generally parallel relation relative to each other through the range of adjustment.

In the embodiment shown in FIGS. 1, 3 and 4, the slip joint 70 of apparatus 10 includes a pair of axially aligned generally vertical and elongated slots or openings 72 defined by the ears or mounts 64, 66 on the body section of element 40. The slip joint 70 shown in FIGS. 1, 3 and 4 further includes a fulcrum pin or guide element 74 extending through the attachment section 26 of element 20 and having one end, at least partially, extending into each slot or opening 72 defined by each ear or mount 64 and 66 on the body section of element 40.

Preferably, the vertically elongated slot or opening 72 defined by each ear or mount 64, 66 on the body section of element 40 has a closed margin. Accordingly, and as shown in FIG. 3, opposed ends of each slot or opening 72 defines upper and lower stops 76 and 78, respectively. As will be appreciated, and during adjustment of the universal apparatus 10, pin 74 of the slip joint 70 is permitted to vertically move freely between anywhere between the upper and lower stops 76 and 78 thereby maintaining the first and second elements 20 and 40, respectively, of the universal apparatus 10 interconnected to each other throughout the range of vertical adjustment relative to each other. Moreover, the range of adjustment permitted by slip joint 70 permits adjustment of the vertical distance between bucket lip engaging surfaces 24 and 44 of elements 20 and 40, respectively, anywhere between D and D' (FIG. 4) while maintaining those surfaces 24, 44 in generally parallel relation relative to each other through the range of adjustment.

FIGS. 6 and 7 illustrate an alternative form of slip joint for the multipiece and universal digging tooth attachment apparatus of the present invention disclosure. This alternative form of slip joint is designated generally by reference numeral 170. The elements of this alternative multipiece and universal digging tooth attachment apparatus that are functionally analogous to those components discussed above regarding multipiece and universal digging tooth attachment apparatus 10 are designated by reference numerals identical to those listed above with the exception this embodiment uses reference numeral in the 100 series.

In the exemplary embodiment shown in FIG. 6, the multipiece and universal digging tooth attachment apparatus 100 includes first and second elements 120 and 140. Element 120 of apparatus 100 includes, at a forward end thereof, a laterally narrowed attachment section 126 defining two generally parallel outer surfaces 127 and 129 (FIG. 6) spaced a predetermined lateral distance apart from each other. Element 120 of apparatus 100 has a longitudinally extending elongate section 122 similar to elongate section 22 on apparatus 10 discussed above.

Apparatus 100 is further provided with an enlarged body section 160. In the illustrated embodiment, body section 160 is formed integral with and toward a forward end of element 140. The adapter body section 160 includes an abutment surface 163 extending transversely across the width thereof and against which the blunt end or edge of implement 16 (FIG. 4) abuts when apparatus 100 is assembled to the bucket lip 12. Like body section 60 on apparatus 10, and as shown in FIG. 6, the body section 160 of element 140 includes a pair of generally parallel ears or mounts 164 and 166 which embrace a free end attachment section 126 of element 120 there between. That is, inner surfaces 167 and 169 on the ears or mounts 164 and 166, respectively, of element 140 are laterally spaced apart a distance equal to or slightly greater than the predetermined distance separating the laterally spaced outer surfaces 127 and 129 on the attachment section 126 of the first element 120 of the multipiece apparatus 100. Moreover, and as shown in FIG. 7, element 140 includes a longitudinally extended elongate section 142 similar to elongate section 42 on apparatus 10 discussed above In this embodiment, slip joint 170 includes cooperating instrumentalities on the first and second elements 120 and 140, respectively, of apparatus 100 for establishing a plurality of vertically spaced fulcrum supports about which the elements 120 and 140 can be adjusted relative to each other. More specifically, the outer surfaces 127 an 129 on the attachment section 126 of element 120 and the inner surfaces 167 and 169, respectively, on the ears or mounts 164 and 166 of the body section 160 define a tongue and groove type pivot structure there between.

Since the tongue and pivot structure between the surfaces 127, 167 and 129, and 169 are the same, only the pivot structure between surfaces 127, 167 will be discussed in detail. As shown in FIG. 6, element 140 of apparatus 110 includes at least one arcuate tongue 172 projecting laterally outward from and preferably formed integral with outer surface 127. In a preferred form, element 140 of apparatus 110 includes two radially spaced arcuate tongues 172 and 172' (FIG. 7) projecting laterally outward from and preferably formed integral with outer surface 127. As shown in FIG. 7, the inner surface 167 on ear or mount 164 is provided with a series of arcuate and vertically spaced grooves 174 therein.

The spaced grooves 174 on the inner surface 167 and the tongue 172 projecting from surface 127 are suitably configured to allow the tongue 172 and grooves 174 to cooperate relative to each other to define a series of vertically spaced fulcrum supports about which elements 120 and 140 can be vertically adjusted relative to each other while maintaining the elements 120 and 140 interconnected to each other, thus, enhancing the strength of apparatus 100. Moreover, the range of adjustment permitted by the slip joint 170 permits adjustment of the vertical distance between bucket lip engaging surfaces 124 and 144 of elongate sections 122 and 142, respectively, while maintaining surfaces 124, 144 in generally parallel relation relative to each throughout the range of vertical adjustment. As such, surfaces 124 and 144 of the elongate sections 122 and 142 are permitted to engage, along their respective lengths, the upper and lower surfaces, respectively, of the bucket lip.

Figure 8:
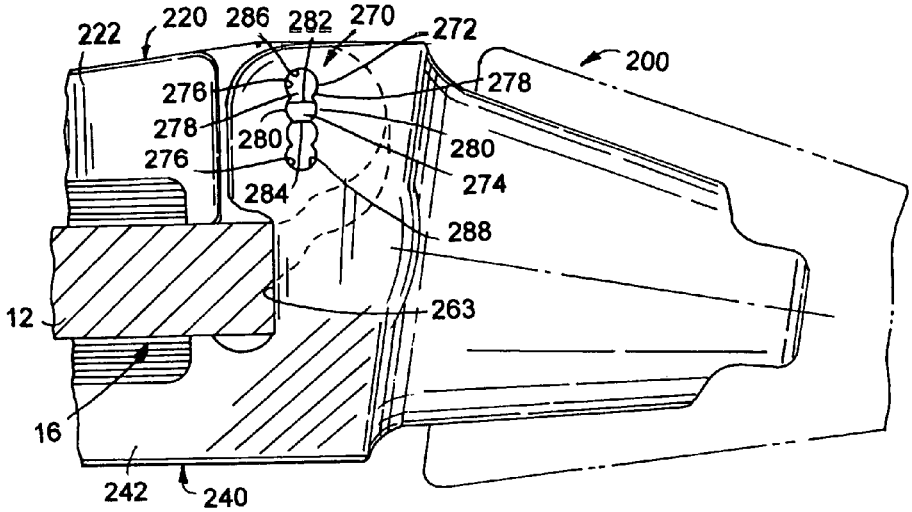
FIG. 8 is a fragmentary side elevational view of another embodiment of the invention disclosure.
Figure 9:
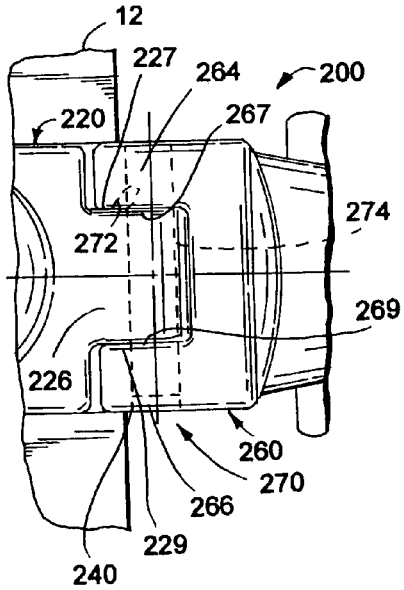
FIG. 9 is a fragmentary top plan view of the embodiment of the invention disclosure illustrated in FIG. 8.

FIGS. 8 and 9 illustrate an alternative form of slip joint for the multipiece and universal digging tooth attachment apparatus of the present invention. This alternative form of slip joint is designated generally by reference numeral 270. The elements of this alternative multipiece and universal digging tooth attachment apparatus that are functionally analogous to those components discussed above regarding multipiece and universal digging tooth attachment apparatus 10 are designated by reference numerals identical to those listed above with the exception this embodiment uses reference numeral in the 200 series.

In the embodiment shown in FIGS. 8 and 9, the multipiece and universal digging tooth attachment apparatus 200 includes first and second elements 220 and 240. The first element 220 of apparatus 200 includes, at a forward end thereof, an attachment section 226 defining two generally parallel outer surfaces 227 and 229 (FIG. 9) spaced a predetermined lateral distance apart from each other. Element 220 of apparatus 200 has an elongate section 222 similar to elongate section 22 on apparatus 10 discussed above.

Apparatus 200 is also provided with an enlarged body section 260. As with the other embodiments, the adapter body section 260 is preferably formed integral with element 240. As shown in FIG. 8, body section 260 includes an abutment surface 263 extending transversely across the width thereof and against which the blunt end or edge of the bucket lip 12 abuts when apparatus 200 is assembled to implement 16. Like body section 60 on apparatus 10, and as shown in FIG. 9, body section 260 of element 240 includes a pair of generally parallel ears or mounts 264 and 266 which embrace the free end of attachment section 226 of element 220 therebetween. Inner surfaces 267 and 269 on the ears 264 and 266, respectively, of element 240 are laterally spaced apart a distance equal to or slightly greater than the predetermined distance separating the laterally spaced outer surfaces 227 and 229 on attachment section 226 of the first element 220 of the multipiece apparatus 200. As shown in FIG. 8, element 240 of apparatus 200 has an elongate section 242 longitudinally extending from the body section 260 and similar to elongate section 42 on apparatus 10 discussed above.

Slip joint 270 includes cooperating instrumentalities on elements 220 and 240 of apparatus 200 for establishing a plurality of vertically spaced fulcrum supports about which the elements 220 and 240, respectively, can be adjusted relative to each other. More specifically, slip joint 270 of apparatus 200 includes an axially aligned generally vertical and preferably elongated channel 272 defined by each ear or mount 264, 266 on the body section 260 of element 240. The slip joint 270 shown in FIGS. 8 and 9 further includes a fulcrum pin or guide element 274 carried by the attachment section 226 of element 220.

The elongated channel 272 defined by element 240 of apparatus 200 in combination with guide element 274 establishes a series of adjustable fulcrum supports for affecting adjustment of the element 220 relative to element 240. As shown in FIG. 8, each elongated channel 272 is comprised of a series of vertically spaced generally circular slotways 276 all of which are in communication through the medium of a guideway 278 extending between vertically adjacent slotways 276. Moreover, opposed and free ends of the fulcrum pin or guide element 274 extend beyond the outer surfaces 227 and 229 of the attachment section 226 of element 220 and project, at least partially, into the channel 272 defined by each ear or mount 264, 266 on the adapter body section 260 of element 240 whereby interconnecting elements 220 and 240 to each other.

As shown in FIG. 8, each free end portion of the fulcrum pin or guide element 274 has curved side portions 280 adapted to cooperate with the generally circular slotways 276 hereinbefore described. Moreover, each free end portion of the fulcrum pin or guide element 274 has generally flat portions 282 and 284 adapted to cooperate with the guideway 278 in response to and when element 220 is sufficiently rotated to allow guide element 274 to be vertically moved or shifted to effect the desired adjustment of the surfaces 224 and 244 on elements 220 and 240, respectively, relative to each other.

Preferably, the vertically elongated channel 272 of slip joint 270 has a closed margin. Accordingly, and as shown in FIG. 8, opposed ends of channel 272 define upper and lower stops 286 and 288, respectively. During adjustment of the universal apparatus 200, guide element 274 is permitted to vertically move with the first element 220 freely between the upper and lower stops 286 and 288 of the slip joint 270 thereby maintaining the first and second elements 220 and 240, respectively, of the universal apparatus 200 interconnected to each other throughout the range of vertical adjustment relative to each other, thus, enhancing the strength of apparatus 200. Moreover, the range of adjustment permitted by slip joint 270 permits adjustment of the vertical distance between bucket lip engaging surfaces 224 and 244 of elongate sections 222 and 242, respectively, while maintaining surfaces 224, 244 in generally parallel relation relative to each other through the range of adjustment. As such, surfaces 224 and 244 of the elongate sections 222 and 242 are permitted to engage, along their respective lengths, the upper and lower surfaces, respectively, of the bucket lip.

Figure 10:
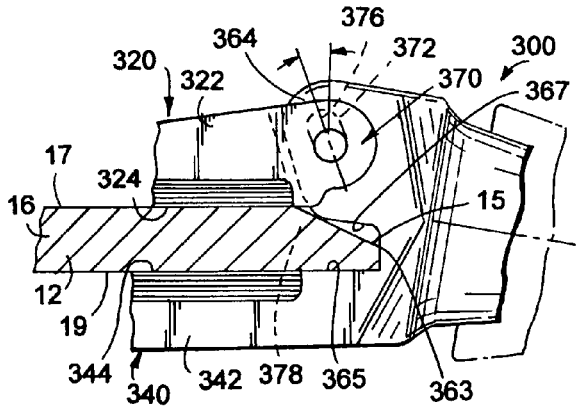
FIG. 10 is a fragmentary side elevational view of another embodiment of the invention disclosure.
Figure 11:
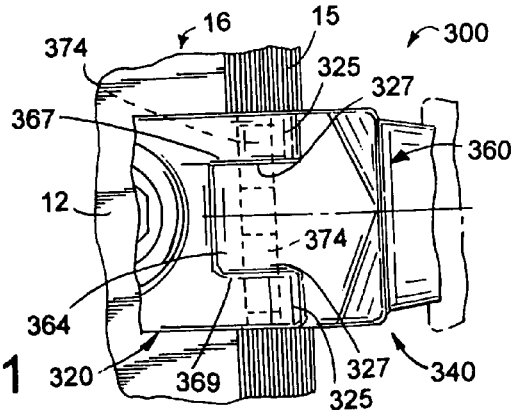
FIG. 11 is a fragmentary top plan view of the embodiment shown in FIG. 10.

FIGS. 10 and 11 illustrate an alternative form for the multipiece and universal digging tooth attachment apparatus and which finds particular utility with a earth moving implement 16, such as a bucket or scoop, having a bottom wall 14 configured with a bevel 15 so as to provide a narrowed and relatively sharp edge 12 to the implement 16. The elements of this alternative multipiece and universal digging tooth attachment apparatus that are functionally analogous to those components discussed above regarding multipiece and universal digging tooth attachment apparatus 10 are designated by reference numerals identical to those listed above with the exception this embodiment uses reference numeral in the 300 series.

In the embodiment shown in FIGS. 10 and 11, the multipiece and universal digging tooth attachment apparatus 300 includes first and second elements 320 and 340. Like element 20 discussed above regarding apparatus 10, element 320 of apparatus 300 has an elongate section 322 defining a generally planar surface 324. Along the length thereof, planar surface 324 of section 322 is adapted to abut and engage with the upper side 17 of the bucket lip 12. As shown in FIG. 11, element 320 of apparatus 300 further includes, at a forward end thereof, a pair of laterally spaced ears or mounts 325 and 326 defining two generally parallel inner surfaces 327 and 329 (FIG. 11) spaced a predetermined lateral distance apart.

Like element 40 discussed above, element 340 of the multipiece apparatus 300 has an elongate section 342 defining a generally planar surface 344. Along the length thereof, surface 344 of elongate section 342 is adapted to abut and engage with the bottom or lower side or surface 19 of the bucket lip directly opposite from the elongate section 322 of element 20.

Apparatus 300 further includes an enlarged body section 360 which, in the illustrated embodiment, is formed integral with and toward a forward end of element 340. As shown in FIG. 11, body section 360 includes a generally centralized and rearwardly extending attachment section 364 which is embraced on opposite sides by the forward extending ears 325 and 326 on element 320. That is, outer surfaces 367 and 369 on the attachment section 364 of element 340 are laterally spaced apart a distance equal to or slightly less than the predetermined distance separating the laterally spaced surfaces 327 and 329 on the two ears 325 and 326, respectively, of element 320 of the multipiece apparatus 300.

As shown in FIG. 10, the body section of element 340 of apparatus 300 defines an open-sided laterally extending channel 365 extending upwardly from the generally planar surface 344 for receiving and accommodating a portion of the beveled edge 15 of bucket lip 12 therewithin. Notably, in the illustrated embodiment, channel 365 terminates at a forward end in an abutment surface 363. As shown, channel 365 extends longitudinally forward a greater distance than in the other embodiments and beneath the attachment section 364 of element 340. In this embodiment, a top wall or surface 367 of the channel 365 is vertically slanted or angled in an upward and rear direction to wrap the beveled edge 15 of the bucket lip at an angle.

The multipiece apparatus 300 further includes a slip joint 370 for advantageously permitting adjustment of the vertical distance between planar surfaces 324 and 344 on sections 322 and 342 of elements 320 and 340, respectively, so as to accommodate variations in thicknesses of the bucket lip of different earth moving implements. In the embodiment illustrated in FIG. 10, slip joint 370 of apparatus 300 includes an elongated open-sided slot or channel 372 defined by and opening to the outer surfaces 367 and 369 of the attachment section 364 of element 340. Notably, and as shown in FIG. 10, the elongated open-sided slot or channel 372 is vertically canted from front to rear at an angle θ relative to a vertical plane. In a preferred embodiment, the elongated open-sided slot or channel 372 is vertically canted from front to rear at an angle ranging between about 12° to about 20° relative to a vertical plane. In a most preferred embodiment, the elongated open-sided slot or channel 372 is vertically canted from front to rear at an angle of about 17° relative to a vertical plane.

Slip joint 370 of apparatus 300 further includes a pair of axially aligned pivot pins or guide elements 374 and 374' carried by the mounting ears 325 and 326 of the first element 320. As shown in FIG. 11, a lengthwise portion of each guide element or pin 374, 374' projects into and is guided by the open-sided elongated slot or channel 372 defined by the attachment section 364 of element 340.

Preferably, the elongated slot or opening 372 defined by the attachment section 364 of element 340 has a closed margin. Accordingly, and as shown in FIG. 10, opposed ends of the elongated slot 372 defines upper and lower stops 376 and 378, respectively. During adjustment of apparatus 300, guide elements 374 and 374' of the slip joint 370 are permitted to vertically move between the upper and lower stops 376 and 378 of the slip joint 370 thereby maintaining the first and second elements 320 and 340, respectively, of apparatus 300 interconnected to each other throughout their range of vertical adjustment relative to each other thus enhancing the strength of apparatus 300. Moreover, the range of adjustment permitted by slip joint 370 permits adjustment of the distance between bucket lip engaging surfaces 324 and 344 of elements 320 and 340, respectively while maintaining surfaces 324, 344 in generally parallel relation relative to each other through the range of adjustment. As such, surfaces 324 and 344 of the elongate sections 322 and 342 are permitted to engage, along their respective lengths, the upper and lower surfaces, respectively, of the bucket lip.

FIGS. 12 through 17 illustrate an alternative form of multipiece and universal digging tooth attachment apparatus of the present invention disclosure. This alternative form of multipiece and universal digging tooth attachment apparatus is designated generally by reference numeral 400. The elements of this alternative multipiece and universal digging tooth attachment apparatus that are functionally analogous to those components discussed above regarding multipiece and universal digging tooth attachment apparatus 10 are designated by reference numerals identical to those listed above with the exception this embodiment uses reference numeral in the 400 series.

Figure 12:
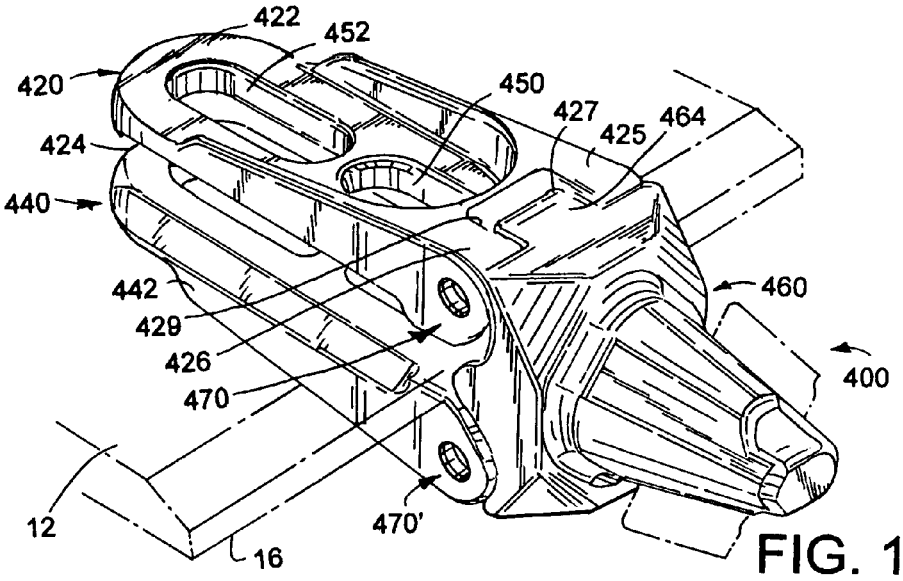
FIG. 12 is a left top perspective view of another embodiment of the present invention disclosure.
Figure 13:
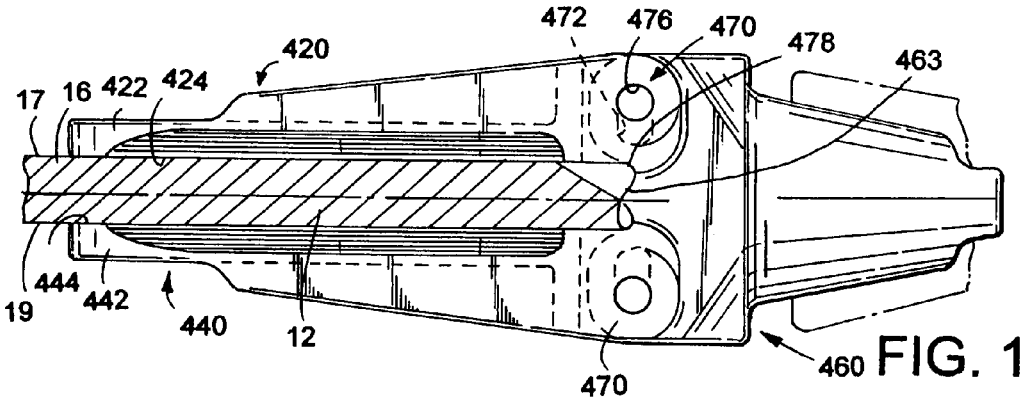
FIG. 13 is a left side elevational view of the embodiment of the invention disclosure illustrated in FIG. 12.
Figure 14:
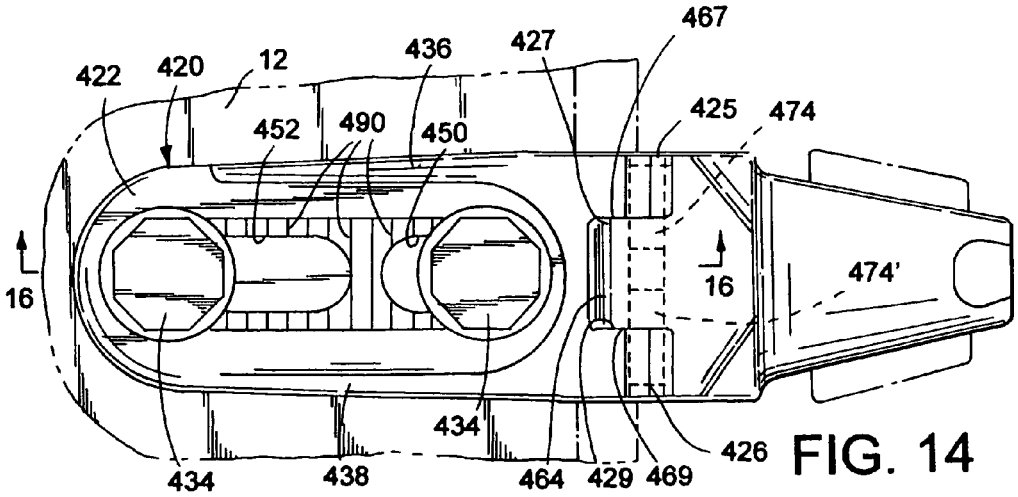
FIG. 14 is a top plan view of the embodiment of the invention disclosure illustrated in FIG. 13.

In the embodiment shown in FIGS. 12, 13 and 14, the multipiece and universal digging tooth attachment apparatus 400 includes first and second elements 420 and 440 along with an enlarged adapter body piece 460. Like element 20 discussed above regarding apparatus 10, element 420 of apparatus 400 has a longitudinally extended elongate section 422 defining a generally planar surface 424. Along the length thereof, the planar surface 424 of section 422 is adapted to abut and engage with the upper side 17 of the bucket lip 12. As shown in FIG. 12, element 420 of apparatus 400 further includes, at a forward end thereof, a pair of laterally spaced ears or mounts 425 and 426 defining two generally parallel inner surfaces 427 and 429 (FIGS. 12 and 14) spaced a predetermined lateral distance apart.

Like element 40 discussed above, element 440 of the multipiece apparatus 400 has a longitudinally extended elongate section 442 defining a generally planar surface 444. Along the length thereof, surface 444 of section 442 is adapted to abut and engage with the bottom or lower side or surface 19 of the bucket lip 12 directly opposite from the elongate section 422 of element 420. In the embodiment shown in FIG. 15, and at a forward end thereof, element 440 is further provided with a pair of laterally spaced ears or mounts 445 and 446 defining two generally parallel inner surfaces 447 and 449 spaced a predetermined lateral distance apart.

Besides having a digging tooth formed as an integral part thereof or attached thereto, and as shown in FIG. 14, the enlarged body piece 460 of apparatus 400 further includes a generally centralized and rearwardly extending attachment section 464 embraced on opposite sides by the forward extending ears 425 and 426 on element 420. Outer surfaces 467 and 469 on section 464 of the body piece 460 are laterally spaced apart a distance equal to or slightly less than the predetermined distance separating the laterally spaced inner surfaces 427 and 429 on the two ears 425 and 426, respectively, of element 420 of the multipiece apparatus 400.

Figure 15:
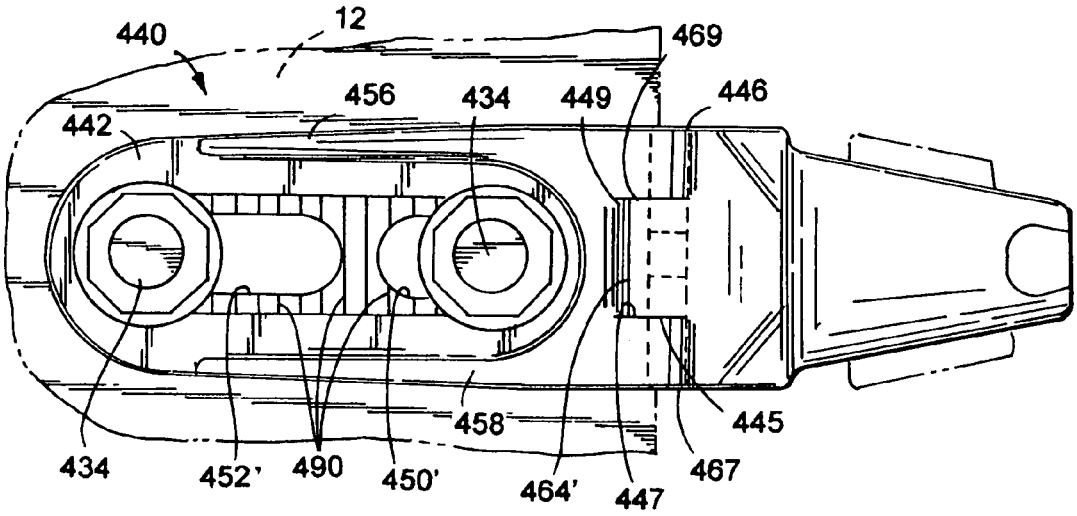
FIG. 15 is a bottom plan view of the embodiment of the invention disclosure shown in FIG. 13.

Moreover, and as shown in FIG. 15, the enlarged body piece 460 of the multipiece apparatus 400 also includes a lower generally centralized and rearwardly extending attachment section 464' which is embraced on opposite sides by forward extending ears 445 and 446 on element 440. Outer surfaces 467' and 469' on the attachment section 464' of the body piece 460 are laterally spaced apart a distance equal to or slightly less than the predetermined distance separating the laterally spaced inner surfaces 447 and 449 on the ears 445 and 446, respectively, of element 440 of the multipiece apparatus 400. Preferably, body piece 460 further includes an abutment surface 463 arranged vertically between the attachment sections 464, 464' and against which the front or blunt edge of the bucket bottom wall preferably abuts when apparatus 400 is secured to the implement.

The multipiece apparatus 400 further includes two vertically spaced slip joints 470 and 470' for advantageously permitting adjustment of the vertical distance between planar surfaces 424 and 444 on the elongate sections 422 and 442 on elements 420 and 440, respectively, so as to add versatility to the multipiece apparatus 400 by allowing a digging tooth to be connected to different buckets having differing bucket lip thicknesses. In the embodiment illustrated in FIGS. 12 and 13, the slip joints 470 and 470' are substantially similar. Accordingly, only slip joint 470 of apparatus 400 will be discussed in detail.

Figure 16:
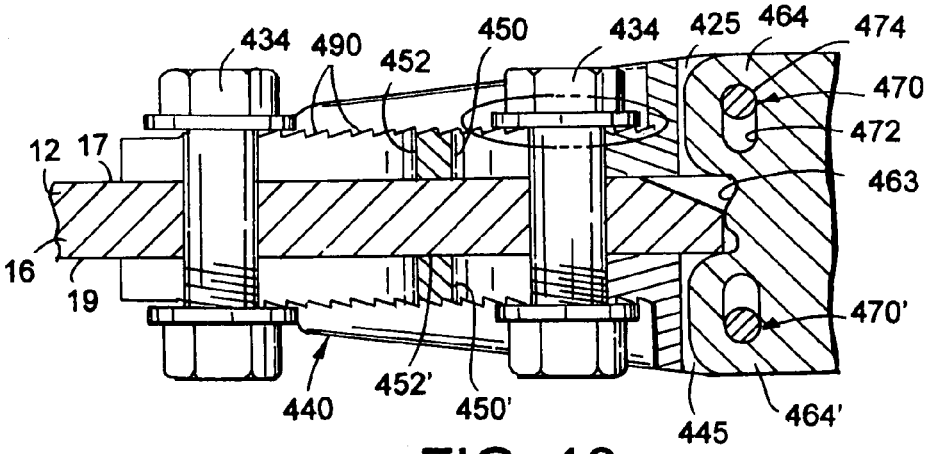
FIG. 16 is an enlarged sectional view taken along line 16-16 of FIG. 14.

As shown in FIGS. 13 and 16, slip joint 470 for apparatus 400 includes an elongated open-sided slot or channel 472 defined by and opening to the outer surfaces 467 and 469 of attachment section 469 of body piece 460. As shown in FIG. 14, slip joint 470 of apparatus 400 further includes a pair of axially aligned pivot pins or guide elements 474 and 474' carried by the mounting ears 425 and 426 of the first element 420. As shown, a lengthwise portion of each guide element or pin 474, 474' projects into and is guided by the open-sided elongated slot or channel 472 defined by the attachment section 464 on the body piece 460.

Preferably, the elongated slot or opening 472 defined by the attachment section 464 of the body piece 460 has a closed margin. Accordingly, and as shown in FIG. 13, opposed ends of the elongated slot 472 defines upper and lower stops 476 and 478, respectively. As will be appreciated, and during adjustment of the apparatus 400, the guide elements 474 and 474' of the slip joint 470 are permitted to vertically move freely anywhere between the upper and lower stops 476 and 478 of the slip joint 470 thereby maintaining the elements 420 and 440 interconnected to each other throughout their range of vertical adjustment relative to each other and thereby enhancing the strength of apparatus 400. Moreover, the range of adjustment permitted by the slip joint 470 permits adjustment of the vertical distance between bucket lip engaging surfaces 424 and 444 of elements 420 and 440, respectively while maintaining those surfaces 424, 444 in generally parallel relation relative to each other through the range of adjustment. As such, surfaces 424 and 444 of the elongate sections 422 and 442 are permitted to engage, along their respective lengths, the upper and lower surfaces, respectively, of the bucket lip. With the embodiment shown in FIGS. 12, 13 and 15, the range of adjustment of apparatus 400 is significantly enhanced by the second slip joint 470' which permits further adjustment of the vertical distance between the bucket lip engaging surfaces 424 and 444 of elements 420 and 440, respectively while maintaining those surfaces 424, 444 in generally parallel relation relative to each other through the range of adjustment.

To accommodate differences in bolt hole locations and/or spacings in the ground moving implement 16, and as shown in FIGS. 14 and 15, the elongate section 422 of element 420 and the elongate section 442 of element 440 each defines a pair of aligned and longitudinally elongated slots or openings 450 and 452 along with 450' and 452', respectively. The slots 450, 452 and 450' and 452' are preferably configured to allow a lengthwise portion of a bolt of a fastener assembly 434 to pass through the elongate section 422 and to be secured as with a conventional nut whereby releasably securing element 440 to the lower side of the bucket lip directly beneath section 422 of element 420. As shown in FIGS. 14 and 15, the fasteners assembly 434 furthermore preferably includes a conventional apertured washer between the body section of the threaded bolt and elongate section 422 as well as between the nut and elongated section 442.

Elements 420 and 440 are preferably configured to facilitate securement of the multiple pieces of the universal adapter to the bucket lip of the implement. As shown in FIGS. 14 and 15, and in the immediate area surrounding and extending between the elongated slots or openings 450 and 452 along with 450' and 452', of elements 420, and 440, respectively, that surface adapted to be engaged by the apertured washer of fastener assembly 434 is configured with a series of raised ridges 490. The raised ridges 490 preferably extend generally parallel to each other and away from the closed margin of the respective slots 450, 452 and 450' and 452'. Although illustrated as only partially extending between the respective side walls 436, 438 and 456, 458 of elements 420 and 440, respectively, such serrations or raised ridges 490 could readily extend completely between the side walls 436, 438 and side walls 456, 458 of elements 420 and 440, respectively, or terminate somewhere between the closed margin of slots 450, 452 and 450, 452' and the side walls of the elements 420 and 440 without detracting or departing from the spirit and scope of the invention.

Figure 17:
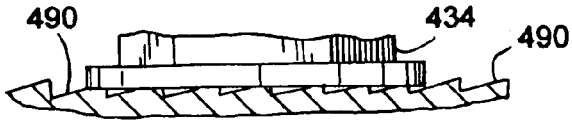
FIG. 17 is an enlarged view of that portion encircled in phantom lines in FIG. 16.

The serrations or raised ridges 490 can take a myriad of different profiles without detracting or departing from the spirit and scope of the present invention. Suffice it to say, and as illustrated in FIGS. 16 and 17, each serration or raised ridge 490 is configured such that as increased levels of pressure are applied to an apex or upper edge of a serration or ridge by the washer of the fastener assembly 434, those serrations or ridges 490 disposed directly beneath such washer will deform or collapse under compressive forces. Deformation of the raised ridges beneath the washers of fastener assembly 434 will effectively lock elements 420 and 440 in place relative to the bucket lip of the ground engaging implement.

Figure 18B:
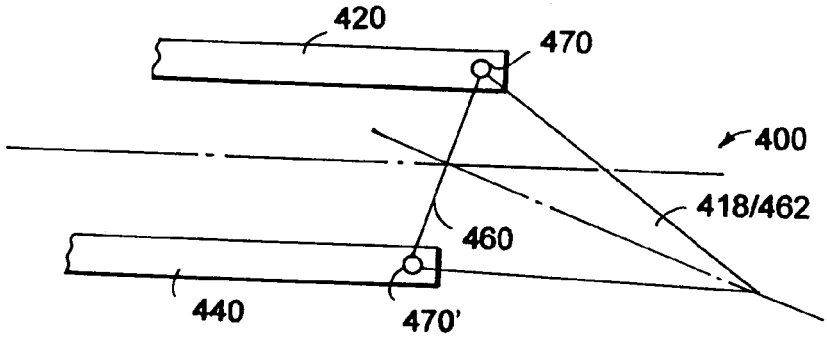
FIGS. 18A, 18B and 18C are schematic representations of the apparatus shown in FIG. 13 in various operational positions.

Besides adding to the adjustability between the generally planar surfaces of the first and second elongate sections, that embodiment of the invention disclosure having two slip joints as an integral part thereof offers additional and heretofore unknown benefits. As shown schematically in FIG. 18, the provision of a double slip joint allows the pitch angle of either the nose portion on the body section of the apparatus or the digging tooth formed as an integral part thereof to be readily altered as required. That is, the double slip joint 470 and 470' permits the longitudinal placement of the first and second elements 420 and 440 of apparatus 400 to be adjusted relative to each other and thereby adjusting the pitch angle of either the digging tooth 418 or nose portion 462 carried by adapter body section 460.

Figure 18A:
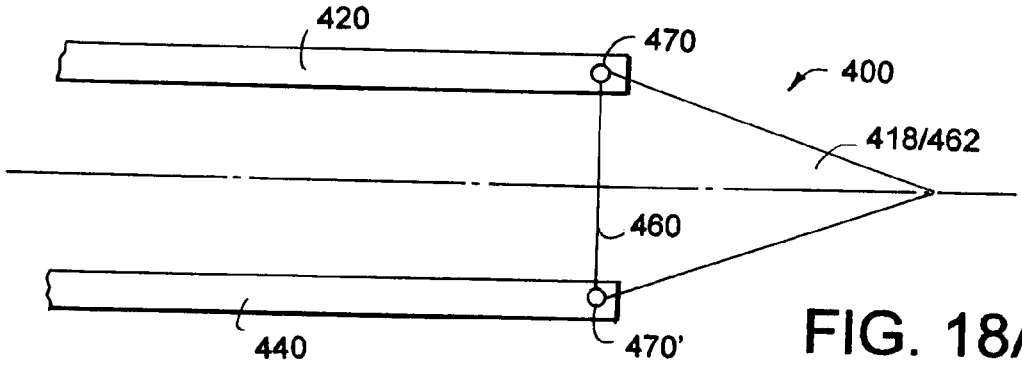
Figure 18C:
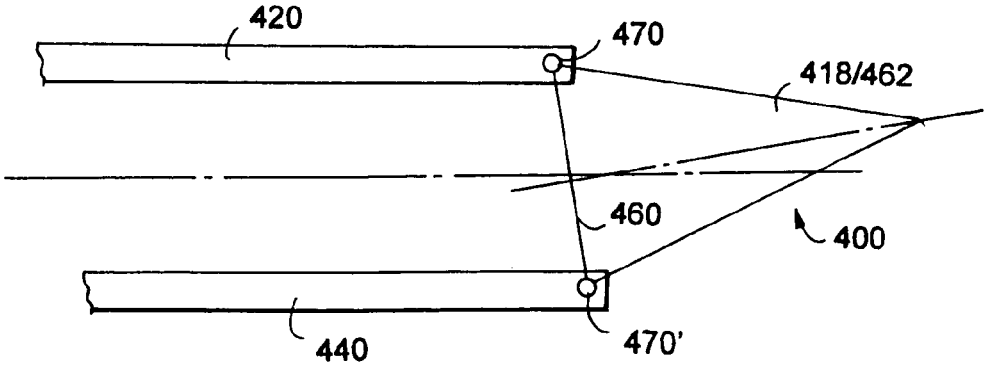

In one form, the pitch angle of the digging tooth 418/nose portion 462 carried by body section 460 can be varied through a range of about 60°. That is, and as shown in FIG. 18A, the digging tooth 418/nose portion 462 carried by body section 460 can be varied between a first position, wherein the digging tooth 418/nose portion 462 carried by the body section 460 is disposed horizontally, to either the position shown in FIG. 18B or FIG. 18C with an included angle of about 60° being provided between the two extremes shown in FIG. 18B and FIG. 18C.

The ability to secure the first and second elements of the universal apparatus in longitudinally adjusted positions relative to each other can be facilitated by the unique surface configuration arranged about the elongated openings provided on the elements of the multipiece apparatus. As mentioned, configuring the first and second elements of the universal apparatus with a series of deformable serrations or ridges arranged in cooperative relationship with the fasteners adapted to pass through the openings in the first and second elements facilitates securement of the first and second elements to the bucket lip of the implement.

FIGS. 19 and 20 illustrate still another alternative form of slip joint for the multipiece and universal digging tooth attachment apparatus of the present invention disclosure. This alternative form of slip joint is designated generally by reference numeral 570. The elements of this alternative multipiece and universal digging tooth attachment apparatus that are functionally analogous to those components discussed above regarding multipiece and universal digging tooth attachment apparatus 10 are designated by reference numerals identical to those listed above with the exception this embodiment uses reference numeral in the 500 series.

In the exemplary embodiment shown in FIG. 20, the multipiece and universal digging tooth attachment apparatus 500 includes first and second elements 520 and 540. As shown in plan in FIG. 19, element 520 includes, at a forward end thereof, a generally U-shaped attachment section 556. Element 520 further includes a longitudinally extended elongate section 522 defining a generally planar surface 524 adapted to abut and engage along the length thereof with an upper surface 17 of the bucket lip 12. Moreover, and like element 40 discussed above, element 540 of apparatus 500 includes a longitudinally extended elongate section 542 defining a generally planar surface 544 adapted to abut and engage along the length thereof with a lower surface 19 of the bucket lip 12.

Apparatus 500 also includes an enlarged body section 560 preferably formed as an integral part of and toward a forward end of element 540. As shown in FIG. 20, body section 560 includes an abutment surface 563 preferably extending transversely across the width thereof and against which the blunt end or edge of implement 16 abuts when apparatus 500 is assembled to the bucket lip 12. As shown in FIGS. 19 and 21, body section 560 of element 540 defines a stepped or counterbored recess 562 configured to snugly and vertically accommodate and embrace the U-shaped attachment section 556 of element 520. As shown in FIG. 20, the adapter body section 560 of element 540 defines a generally horizontal and flat shouldered surface 565 arranged in vertically spaced relation from the planar surface 544 of elongate section 542.

The multipiece universal apparatus 500 further includes a slip joint 570 for advantageously permitting adjustment of the vertical distance between the elongate sections 522 and 542 of elements 520 and 540, respectively, so as to accommodate variations in thicknesses of the bucket lip of different earth moving implements. In the embodiment shown in FIGS. 20 and 21, slip joint 570 includes a bore 572 of predetermined diameter defined by element 540 and opening to the generally horizontal and flat shouldered surface 565. In the illustrated embodiment, bore 572 has a closed outer profile 574 and a blind configuration defining a bottom 575. Slip joint 570 further comprises a generally cylindrically shaped depending projection 582 provided on a lower side or surface of element 520. Suffice it to say, the projection 582 on element 520 is configured for endwise reception and sliding accommodation within the confines of bore 572 defined by element 540. That is, the outside diameter of the projection 582 on element 520 is equal to or slightly less than the inside diameter of the bore 572 defined by element 540. The sliding engagement between the outside diameter of the cylindrically shaped depending projection 582 on element 520 and the inside diameter of bore 572 coupled with the vertical sliding relationship between the attachment section 526 of element 520 and recess 562 on element 540 permits the vertical distance separating surfaces 524 and 544 of elements 520 and 540, respectively, to be adjusted to fit the particular thickness of the bucket lip portion 12 to which the universal attachment apparatus 500 is to be secured while enhancing contact between surfaces 524 and 544 of elements 520 and 540, respectively, and the upper and lower surfaces 17 and 19, respectively, of the bucket lip. Suffice it to say, the axial length of the projection 582 on element 520 is sized such that a sliding relationship is preferably maintained between the projection 582 on element 520 and the inside diameter of bore 572 defined by element 540 throughout the range of vertical adjustment of the elongate sections 522 and 542.

In a preferred form, and as shown in FIG. 20, slip joint 570 furthermore includes member 590 for adjusting the vertical separation between the planar surfaces 524 and 544 of the elongated section 520 and 540, respectively. In the embodiment shown in FIG. 20, member 590 includes a threaded bolt 592 having an externally threaded shank portion 594 an enlarged body portion 596. Moreover, and as shown in FIGS. 20 and 22, the depending projection 582 on element 520 defines an internally threaded bore 584 which is open at opposite ends for accommodating endwise threaded passage of the threaded shank portion 594 of bolt 592 therethrough. As shown, the free end of the threaded shank portion 594 of bolt 592 is adapted to abut and engage with the bottom 575 of the blind bore 572 of element 540. As will be appreciated, and since element 520 is inhibited from rotating therewith, sufficient rotation of bolt 572 will cause the planar surfaces 524 and 544 of the elongated sections 522 and 524, respectively, to vertically separate relative to each other whereby permitting adjustment of the universal multipiece adapter 500 to accommodate for variances in thicknesses of different bucket lips. Moreover, and in the illustrated embodiment, the adapter body section 560 is preferably enlarged so as to offer wear protection to those components, i.e., the enlarged body portion 596 of the bolt 592, disposed downstream of the body section 560.

The multipiece universal apparatus of the present invention disclosure embodies numerous unique and valuable aspects. That is, the multipiece apparatus of the present invention disclosure allows a user to purchase one universal piece of equipment capable of being fitted to different bucket or scoop designs having differing bucket lip thicknesses and which have either blunted or beveled edges. Moreover, and with the present invention disclosure, the particular angle of the bevel at the front or forward edge of the bucket lip is no longer a serious and limiting concern. As will be appreciated, the incorporation of a slip joint allows vertical adjustment of the elements comprising the universal apparatus while maintaining those elements interconnected to each other throughout the range of adjustment relative to each other. Moreover, the range of adjustment permitted by the slip joint readily permits adjustment of the vertical distance between bucket lip engaging surfaces of the elements while maintaining the bucket lip engaging surfaces in generally parallel relation relative to each other through the range of adjustment.

By configuring each elongate section of the universal apparatus elements with longitudinally elongated slots instead of bolt holes, a plethora of bolt hole locations defined by the bucket lip portion can be accommodated thereby significantly adding to the versatility of the present invention. As will be appreciated, the universal apparatus of the present invention prevents economic waste, machine downtime, and operator frustration in attempting to locate a dealer having those parts which perfectly match the lip opening, bevel angle and bolt hole patterns for existing equipment.

The multipiece construction of the present invention disclosure furthermore adds to the uniqueness of the present invention disclosure. Regardless of which embodiment is utilized, the enlarged adapter body section of the multipiece apparatus tends to inhibit wear to those components or elements of the apparatus disposed downstream of the body section. When replacement of a worn component is necessary, the ability of the present invention to separate the elements of the multipiece apparatus tends to reduce the "throw-away" aspect of the multipiece apparatus.

From the foregoing, it will be observed that numerous modifications and variations can be made and effected without departing or detracting from the true spirit and novel concept of the present invention disclosure. Moreover, it will be appreciated, the present disclosure is intended to set forth exemplifications which are not intended to limit the invention disclosure to the specific embodiments illustrated. Rather, this disclosure is intended to cover by the appended claims all such modifications and variations as fall within the spirit and scope of the claims.

What is claimed is:

1. A universal digging tooth attachment apparatus adapted to be secured to a lip portion of a ground engaging implement, said universal digging tooth attachment comprising:

a first element having an elongate section defining a first generally planar surface for abutting and engaging with one face of a bottom wall of said earth moving implement when said first element is secured thereto;

a second element having an elongate section defining a second generally planar surface for abutting and engaging with a second face of the bottom wall of said earth moving implement directly opposite from said elongate section of said first element when said second element is secured to said earth moving implement;

with one of said first and second elements having an earth engaging tooth projecting therefrom; and wherein said first and second elements are interconnected to each other by a slip joint allowing for variable positioning of the first and second elements relative to each other and thereby permitting adjustment of a vertical distance between said first and second planar surfaces while maintaining said first and second elements interconnected to each other throughout the range of adjustment, and wherein the slip joint includes cooperating instrumentalities on said first and second elements for establishing a plurality of vertically spaced fulcrum supports about which the first and second elements can be adjusted relative to each other.

2. The universal digging tooth attachment apparatus according to claim 1, wherein the elongate section of both of said first and second elements defines a longitudinally elongated slot therein.

3. The universal digging tooth attachment apparatus according to claim 1, wherein the elongate section of at least one of said first and second elements includes generally vertical side walls extending along a major lengthwise portion thereof, and with each side wall being configured to facilitate securement of said elongate section to the respective face of the bottom wall of said earth moving implement.

4. The universal digging tooth attachment apparatus according to claim 1, wherein said first element further includes a nose portion extending from said elongated section for releasably mounting said earth engaging tooth thereon.

5. A universal digging tooth attachment apparatus adapted to be secured to a lip portion of a around engaging implement, said universal digging tooth attachment comprising:

a first element having an elongate section defining a first generally planar surface for abutting and engaging with one face of a bottom wall of said earth moving implement when said first element is secured thereto;

a second element having an elongate section defining a second generally planar surface for abutting and engaging with a second face of the bottom wall of said earth moving implement directly opposite from said elongate section of said first element when said second element is secured to said earth moving implement;

with one of said first and second elements having an earth engaging tooth projecting therefrom; and wherein said first and second elements are interconnected to each other by a slip joint allowing for variable positioning of the first and second elements relative to each other and thereby permitting adjustment of a vertical distance between said first and second planar surfaces while maintaining said first and second elements interconnected to each other throughout the range of adjustment, and wherein said slip joint includes a generally vertical open sided channel defined by one of said first and second elements and a guide element carried by the other of said first and second elements and projecting into said open sided channel, with said guide element being movable within predetermined limits defined by said open sided channel so as to allow for variable positioning of the first and second elements relative to each other and thereby permitting adjustment of the distance between the generally planar surfaces of said first and second elements and wherein the generally vertical open sided channel in one of said first and second elements includes a series of vertically spaced slotways forming adjustable fulcrum supports for said guide element, with said vertically adjacent slotways being joined to each other by a guideway so as to permit said guide element to be moved between adjacent slotways.

6. A universal digging tooth attachment apparatus adapted to be secured to a lip portion of an earth moving implement, said universal digging tooth attachment comprising:

a multipiece adapter including a body section with a nose portion configured to releasably accommodate a ground engaging tooth thereon, a first element having an elongate section, said elongate section on said first element defining a first generally planar surface adapted to abut and engage with one face of the lip portion of said earth moving implement, and a second element having an elongate section defining a second generally planar surface adapted to abut and engage with a second face of the lip portion of said earth moving implement directly opposite from said elongate section of said first element when said multipiece adapter is secured to the lip portion of said earth moving implement, with said body section of said multipiece adapter being formed integral with one of said elements; and wherein the two elements of said adapter are interconnected to each other by a slip joint allowing for variable vertical adjustment of first and second planar surfaces relative to each other while maintaining said two elements of said adapter in interconnected and generally parallel relation relative to each other regardless of their adjusted position relative to each other, and wherein said slip joint includes cooperating instrumentalities on said multipiece adapter for establishing a plurality of vertically spaced fulcrum supports about which the first and second adapter elements can be pivotally adjusted relative to each other.

7. The universal digging tooth attachment apparatus according to claim 6, wherein the body section of said multipiece adapter is formed integral with one of said elements, and wherein each elongate section of the two elements of said adapter defines an opening therein, with said opening having a closed margin for allowing a fastener to extend therethrough.

8. The universal digging tooth attachment apparatus according to claim 7, wherein the elongate section of each element of said adapter defines, as an integral part thereof, a series of spaced ridges on that surface of the elements opposed to the generally planar surface, with said spaced ridges extending generally parallel relative to each other and away from the closed margin of said opening.

9. The universal digging tooth attachment apparatus according to claim 6, wherein the elongate section of at least one of two elements of said adapter includes generally vertical side walls extending along a major lengthwise portion of said elongate section, and with each side wall being configured with an angled surface to facilitate securement of said elongate section to the respective face of the lip portion of said earth moving implement.

10. The universal digging tooth attachment apparatus according to claim 6, wherein the body section of said multipiece adapter is formed integral with one of said elements, and wherein said body section of said multipiece adapter includes a pair of ear sections defining laterally spaced inner surfaces spaced apart by a predetermined distance, and wherein the other element of said multipiece adapter includes a projection having two laterally spaced outer surfaces arranged a predetermined distance apart, with the inner and outer surfaces on said first and second adapter elements defining cooperating instrumentalities forming said slip joint and which allow for variable positioning of the first and second adapter elements relative to each other and thereby permitting adjustment of the distance between the generally planar surfaces of said first and second adapter elements.

11. The universal digging tooth attachment apparatus according to claim 6, wherein said slip joint includes a generally vertical open-sided channel defined by said multipiece adapter and a fulcrum pin carried by an element of said adapter and projecting into said open-sided channel, with said fulcrum pin being movable within predetermined limits defined by said channel so as to allow for variable positioning of the pieces of said adapter relative to each other and thereby permitting adjustment of the distance between the generally planar surfaces of the pieces of said adapter.

12. A universal digging tooth attachment apparatus adapted to be secured to a lip portion of an earth moving implement, said universal digging tooth attachment comprising:

a multipiece adapter having a body section configured to releasably accommodate a ground engaging tooth thereon, a first piece having an elongate section connected to said body portion and defining a first generally planar surface for abutting and engaging with one face of the lip portion of said earth moving implement when said multipiece adapter is secured thereto, and a second piece having an elongate section defining a second generally planar surface for abutting and engaging with a second face of the lip portion of said earth moving implement directly opposite from said first elongate section when said multipiece adapter is secured to the lip portion of said earth moving implement; and wherein the elongate section of the second piece of said multipiece adapter is interconnected to the body section of said adapter by a slip joint allowing for variable vertical adjustment of said first and second planar surfaces relative to each other while maintaining the first and the second pieces of said multipiece adapter in interconnected relation relative to each other throughout the range of adjustment of said multipiece adapter, and wherein said slip joint includes cooperating instrumentalities on said second piece and said body section for establishing a plurality of vertically spaced fulcrum supports about which the first and second elongate sections of said multipiece adapter can be pivotally adjusted relative to each other.

13. The universal digging tooth attachment apparatus according to claim 12, wherein the elongate section of both of said first and second pieces of said adapter defines an opening therein, and wherein said opening has a closed margin for allowing a fastener to extend therethrough.

14. The universal digging tooth attachment apparatus according to claim 12, wherein the first and second elongate sections of said multipiece adapter each define, as an integral part thereof, a series of spaced ridges on a surface thereof opposed to the generally parallel surface, and with said protrusions extending generally parallel relative to each other and away from the closed margin of said opening.

15. The universal digging tooth attachment apparatus according to claim 12, wherein said first and second pieces of said multipiece adapter includes generally vertical side walls extending along a major lengthwise portion thereof, and with each side wall being configured with an angled surface to facilitate securement of the elongate section to the respective face of the bottom wall of said earth moving implement.

16. The universal digging tooth attachment apparatus according to claim 12, wherein said slip joint includes a generally vertical open-sided channel defined by one of said second piece and said body section and a fulcrum pin carried by the other of said second piece and the body section, with said fulcrum pin projecting into said open-sided channel, and with said fulcrum pin being movable within predetermined limits defined by said channel so as to allow for variable positioning of the first and second elongate sections relative to each other and thereby permitting adjustment of the distance between the generally planar surfaces defined by said first and second elongate sections.

17. The universal digging tooth attachment apparatus according to claim 12, wherein the first piece of said multipiece adapter is interconnected to the body section of said adapter by a second slip joint which combines with the other slip joint on the adapter to allow for variable adjustment of the pitch of the nose portion of said multipiece adapter relative to the bottom wall of the earth moving implement.

18. The universal digging tooth attachment apparatus according to claim 17, wherein said second slip joint includes a generally vertical open-sided channel defined by one of said first piece and said body section and a fulcrum pin carried by the other of said first piece and the body section, with said fulcrum pin projecting into said open-sided channel, and with said fulcrum pin being movable within predetermined limits defined by said channel so as to allow for variable positioning of the first and second elongate sections relative to each other and thereby permitting adjustment of the distance between the generally planar surfaces defined by said first and second elongate sections.

* * * * *